US005345512A

United States Patent [19]

Lee

[11] Patent Number: 5,345,512

[45] Date of Patent: Sep. 6, 1994

[54] SOUND-WAVE COLLECTOR

[76] Inventor: Tien-Chu Lee, c/o Hung Hsing Patent Service Center, P.O. Box 55-1670, Taipei (10477), Taiwan

[21] Appl. No.: 83,471

[22] Filed: Jun. 30, 1993

[51] Int. Cl.[5] ..... H04R 25/00

[52] U.S. Cl. ..... 381/183; 381/25; 181/136

[58] Field of Search ..... 381/183, 187, 25, 205, 381/188; 181/129, 133, 136; 379/430

[56] References Cited

U.S. PATENT DOCUMENTS 4,997,056 3/1991 Riley ..... 181/129

FOREIGN PATENT DOCUMENTS 2643157 4/1978 Fed. Rep. of Germany .

0110498 8/1980 Japan ..... 381/25

OTHER PUBLICATIONS

Yamaha, YH 1/2/3, Apr. 8, 1993.

*Primary Examiner*—Curtis Kuntz

*Assistant Examiner*—Huyen D. Le

[57] ABSTRACT

A sound-wave collector includes a headframe secured to a pair of retainers held on two opposite sides of a user's head adjacent to the user's two ears, a pair of reflectors each pivotally secured on each retainer and universally positioned behind each ear of the user's two ears each reflector extrapolatively diverging from the area of each user's ear outwardly and sidewardly, and an adjusting controller operatively adjusting a deflecting angle of the two reflectors for efficiently collecting or catching audible sound waves of multiple frequency ranges and reflecting the caught sound waves inwardly into the user's ears for enjoying the music sounding of high fidelity.

8 Claims, 6 Drawing Sheets

SOUND-WAVE COLLECTOR

BACKGROUND OF THE INVENTION

A conventional headphone is provided to be worn on someone's ear for listening music played from a speaker of a phonographic equipment. However, such a conventional headphone is used to "shield" the user's ear for his or her unique listening of the music sounding in order to prevent noise pullution to the others. If for enjoying a hi-fi (high fidelity) music reproduced from a musical equipment like a true attendence in a music concert, such a conventional headphone will not satisfy a perfect enjoyment for a "natural" listening of the music since the ear has been uncomfortably "shielded" by the ear cushion or housing of the conventional headphone. If the music sound waves are merely caught by the human natural ears, the human ears may efficiently "catch" those sound waves of low and middle frequency, but may not well catch the sound waves of higher frequency. It is therefore expected to invent a sound-wave collector for helpfully catching sound waves of multiple frequency ranges by the ears for prefectly enjoying the clear listening of music sounding of low, middle and high frequencies.

SUMMARY OF THE INVENTION

The object of the present invention is to provide a soundwave collector including a headframe secured to a pair of retainers held on two opposite sides of a user's head adjacent to the user's two ears, a pair of reflectors each pivotally secured on each retainer and universally positioned behind each ear of the user's two ears each reflector extrapolatively diverging from the area of each user's ear outwardly and sidewardly, and an adjusting controller operatively adjusting a deflecting angle of the two reflectors for efficiently collecting or catching audible sound waves of multiple frequency ranges and reflecting the caught sound waves inwardly into the user's ears for enjoying the music sounding of high fidelity.

DETAILED DESCRIPTION

Figure 1:
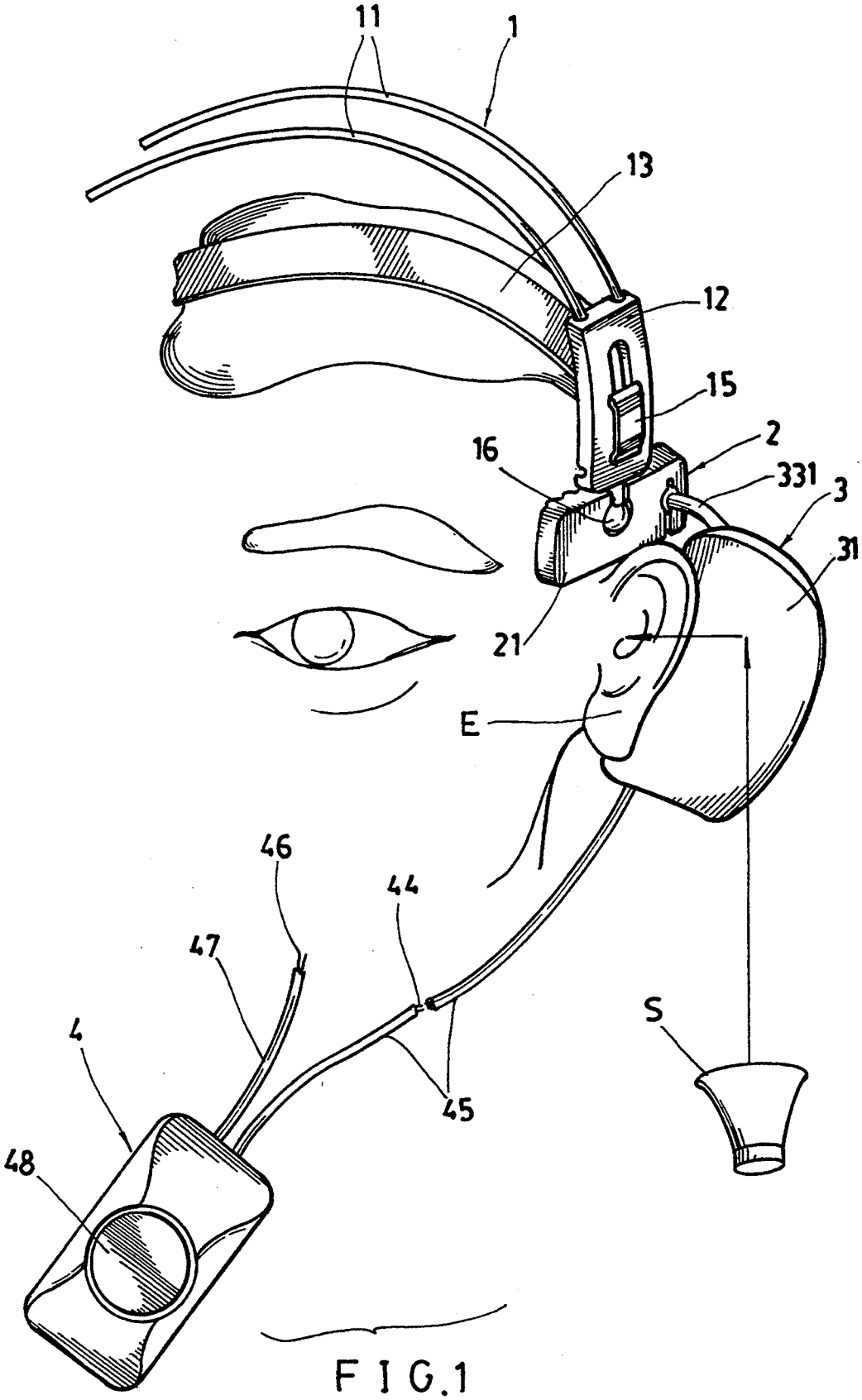
FIG. 1 is a perspective view of the present invention when worn on a user's head.

As shown in the drawing figures, the present invention comprises: a headframe 1, a pair of retainer means 2, a pair of reflector means 3, and an adjusting means 4. The adjusting means 4 may also be omitted if each reflector means 3 is manually operated to adjust its deflecting or reflecting angle approximating to or separating from the user's ear. The retainer means 2 and the headframe 1 may also be modified to be a combination thereof.

The headframe 1 includes: an overhead bracket 11 such as two arcuate rods as shown in FIG. 1 having two base members 12 disposed on two opposite end portions of the overhead bracket 11, a fastener belt 13 fastened on a wearer's head H having two ends of the belt 13 respectively secured to the two base members 12, and a pair of head coupling members 16 each coupling member 16 secured to the base member 12 and pivotally secured to each retainer means 2 adjacent to the wearer's ear E.

The fastener belt 13 has its each end portion secured to a slide member 14 adjustably slidably held on each base member 12.

Figure 7:
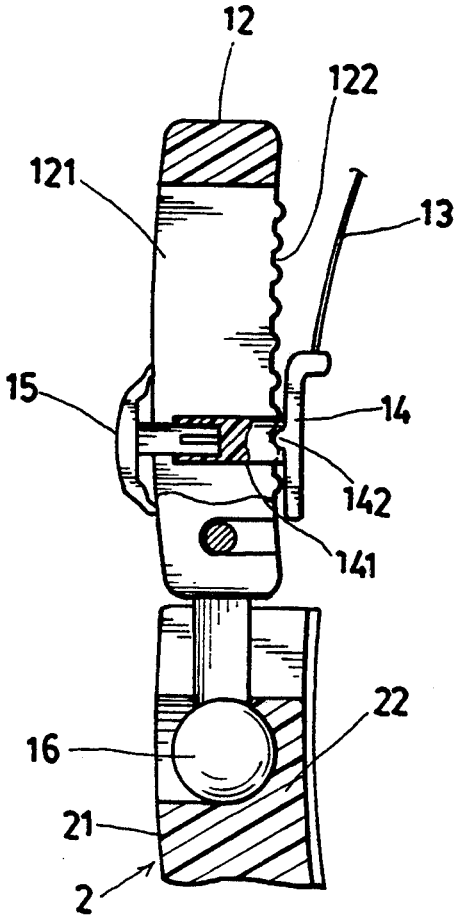
FIG. 7 is a sectional drawing showing a fastener belt secured to a headframe and the retainer means.
Figure 8:
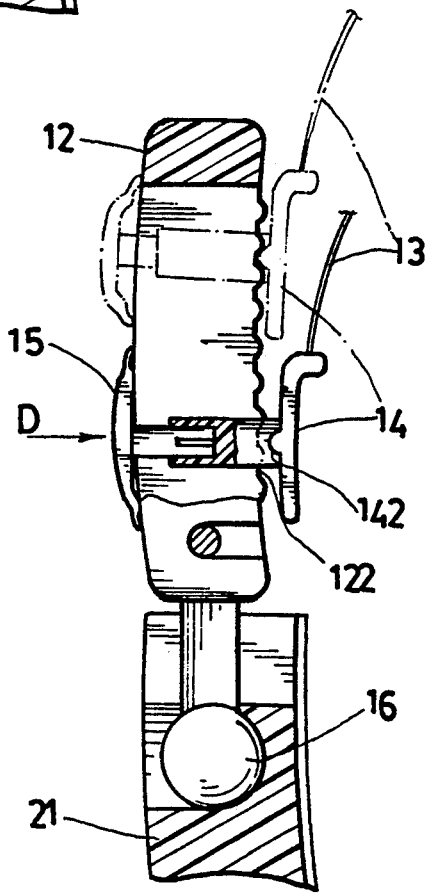
FIG. 8 shows an adjustment of the fastener belt in accordance with the present invention.

The slide member 14 includes a stem 141 protruding outwardly through a slot 121 notched in the base member 12 to be connected with a push button 15 slidably held on an upper surface of the base member 12, and having a lateral extension 142 transversely formed on the slide member 14 to be engageable with a plurality of teeth 122 longitudinally formed on a bottom surface of the base member 12 for a slidable engagement between the slide member 14 and the base member 12 for adjusting the tightness of the belt 13 worn on the wearer's head H by depressing D and moving the push button 15 on the base member 12 as shown in FIGS. 7, 8.

Each retainer means 2 includes: a holding plate 21 contacting a side portion of the wearer's head adjacent to the wearer's ear E, a first socket 22 recessed in an upper portion of the holding plate 21 for universally coupling the head coupling member 16, which may be spherically shaped, in the first socket 22, a second socket 23 recessed in a rear portion of the holding plate 21 for universally coupling a reflector coupling member 332 of each reflector means 3, and a locking member 24 for locking the reflector coupling member 332 in the second socket 23 once an orientation of the reflector means 3 on the retainer means 2 is set.

Figure 2:
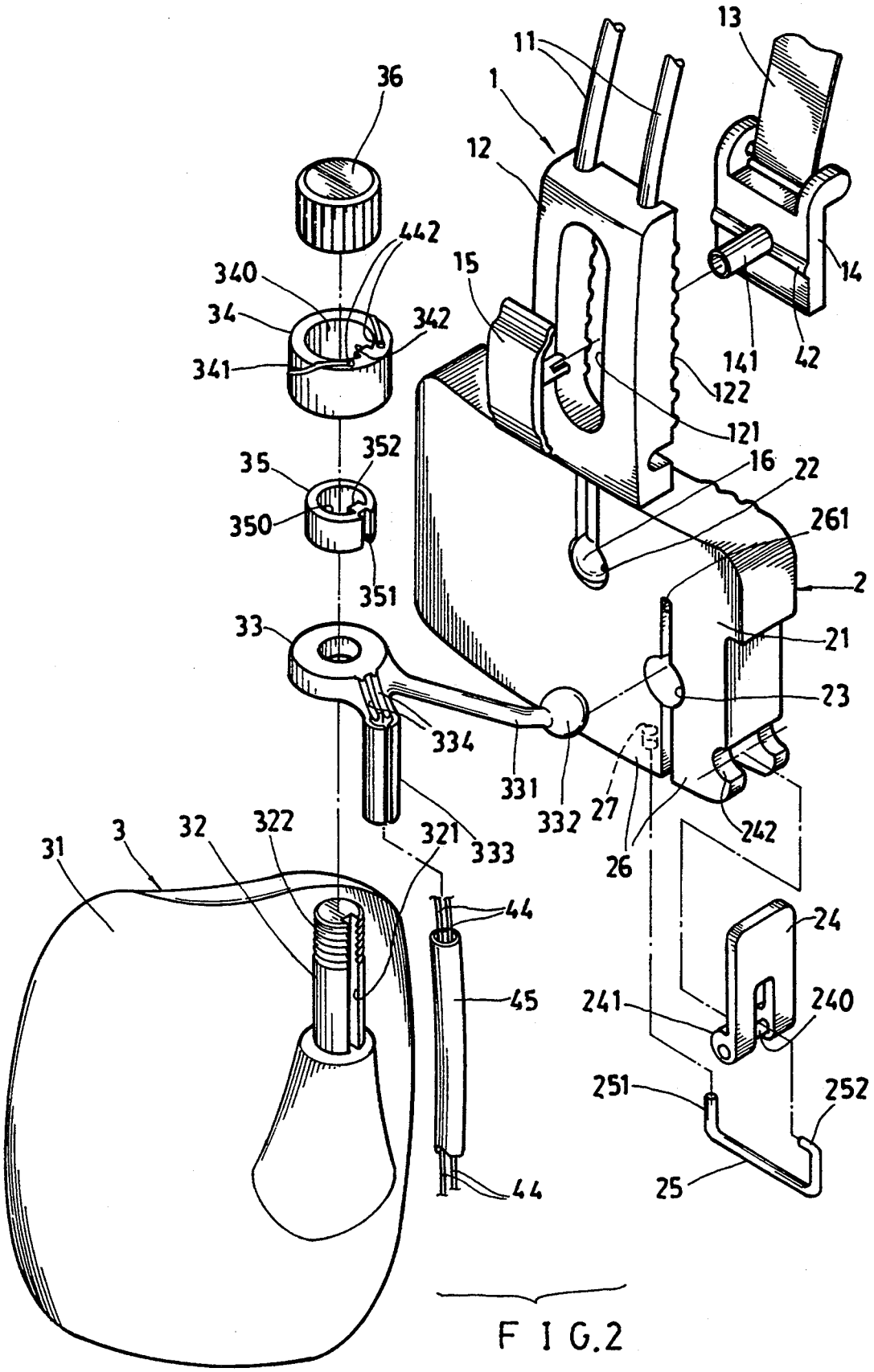
FIG. 2 is an exploded view showing the elements in construction of the present invention.
Figure 3:
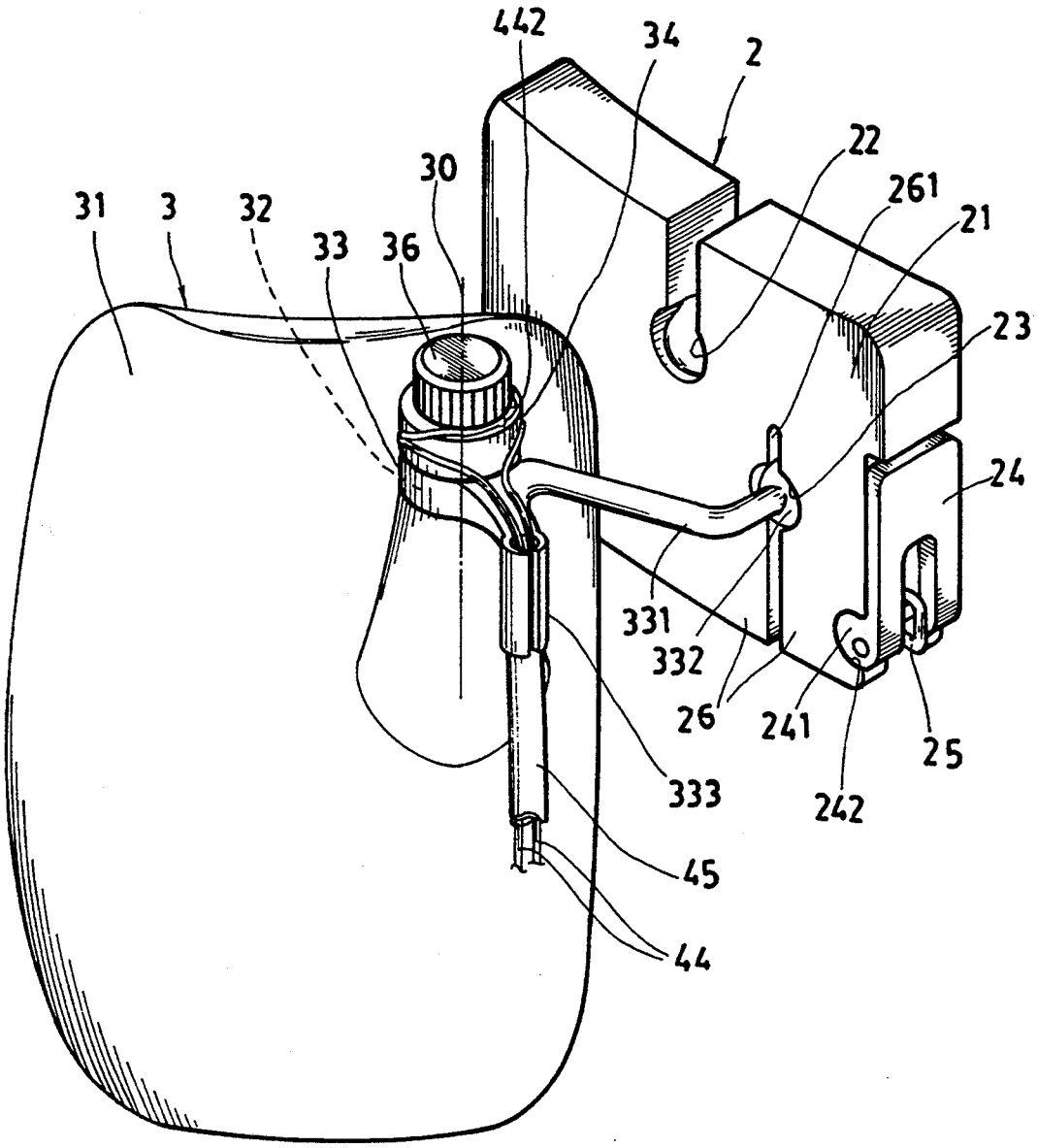
FIG. 3 is a partial perspective view of the present invention.
Figure 6:
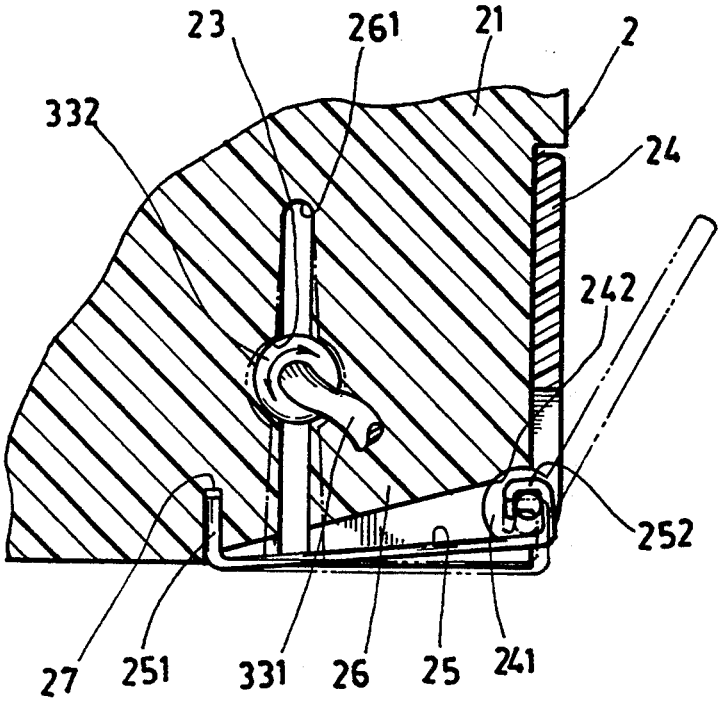
FIG. 6 is a partial sectional drawing of the present invention showing a locking of the reflector coupling member on the retainer means.

The locking member 24 generally formed as a lever as shown in FIGS. 3, 6, 2 has a cam 241 formed on a lower portion of the lever rotatably engageable with a cam socket 242 recessed in one jaw member of the two jaw members 26 bifurcated in a rear portion of the holding plate 21 of the retainer means 2 from a slit 261 communicating with the second socket 23 in the holding plate 21, a tensioning spring 25 having an inner spring end 251 inserted into a spring socket 27 recessed in the holding plate 21 distal from the cam socket 242 and having an outer spring end 252 retaining a pin 240 of the lever of locking member 24 to be normally tensioned for fastening the two jaw members 26 for locking the reflector coupling member 332 in the second socket 23 of the retainer means 2, the locking member 24 being biased outwardly as shown in dotted line of FIG. 6 to release the tensioning spring 25 to unlock the reflector coupling means 332 for free adjusting the orientations of the reflector means 3 on the retainer means 2 for efficiently collecting or catching the sound waves of multiple frequency ranges (such as emitted from a speaker S of FIG. 1) to be reflected into the wearer's ear E.

Figure 5:
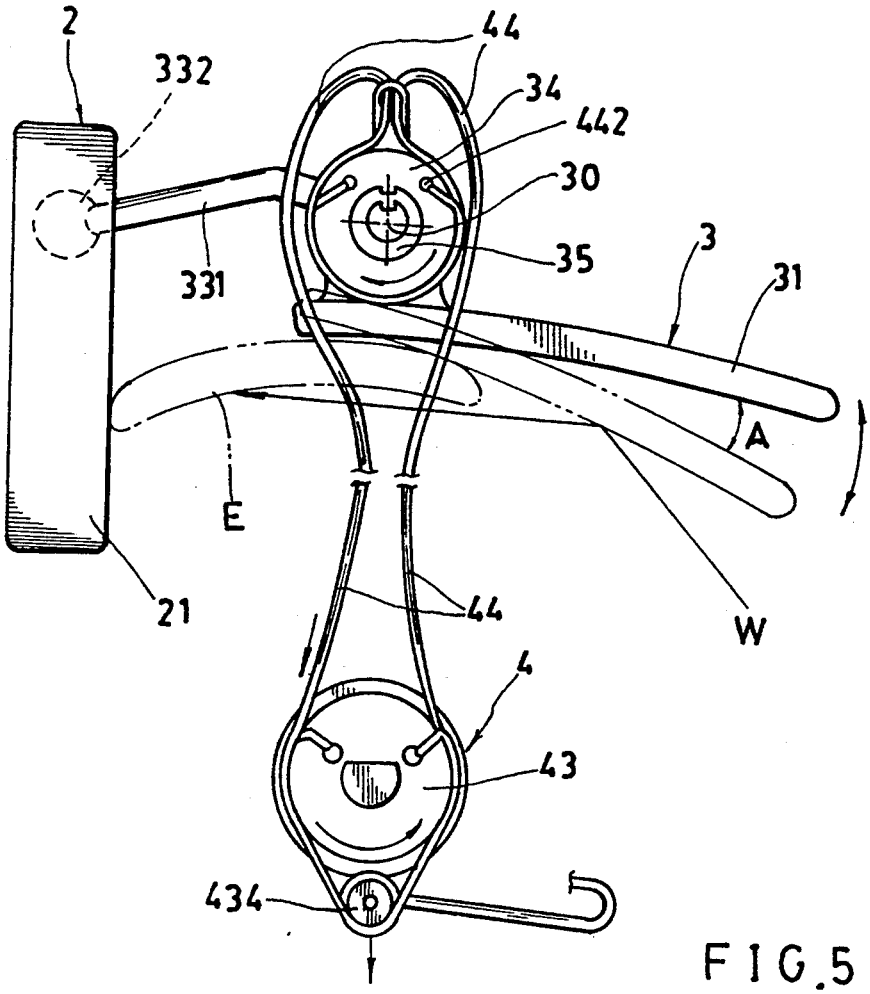
FIG. 5 is an illustration showing an adjustment of the reflector means of the present invention.

Each reflector means 3 includes: a reflector member 31 generally concave inwardly to form the reflecting area with an arcuate shallow recess in a central portion of the reflector member 31 for reflecting sound waves from a sound emitting source such as a speaker S of a musical equipment into the ear (FIG. 1), a shaft 32 formed on a rear or back portion of the reflector member 31, a sleeve member 33 having a coupling arm member 331 secured with the reflector coupling member 332 universally held in the retainer means 2 rotatably engageable with the shaft 32, and a follower pulley 34 secured with the shaft 32, and also secured with and operatively driven by at least a wire 44 connected to an adjusting means 4, whereby upon an adjusting pulling or pushing of the wire 44 of the adjusting means 4, the follower pulley 34 will be rotated to rotate the shaft 32 and the reflector member 31 about a rotating axis 30 axially formed in a center of the sleeve member 33 to adjust a deflecting angle A of the reflector member 31 approximating or separating from the ear for reflecting the incoming soundwaves W into the ear E (FIG. 5).

The follower pulley 34 includes a central hole 340 formed therethrough to be engageable with a collar 35 having a central collar hole 350 engageable with the shaft 32 of the reflector member 31, the follower pulley 34 having at least a wire groove 341 for fixing a wire end portion of the wire 44 into the wire groove 341 to be driven by a driving pulley 43 of the adjusting means 4 and a projection 342 longitudinally formed in a side wall of the central hole 340 of the follower pulley 34 to be engaged with an outer groove 351 recessed in an outer wall of the collar 35, the collar 35 having an inner projection 352 formed in an inside wall in the collar 35 to be engaged with a shaft groove 321 recessed in the shaft 32, and the shaft 32 having male threads 322 formed on an upper portion of the shaft 32 engageable with female threads formed in a nut 36 for locking the nut 36 on the shaft 32 for limiting the follower pulley 34 on the sleeve member 33.

Figure 4:
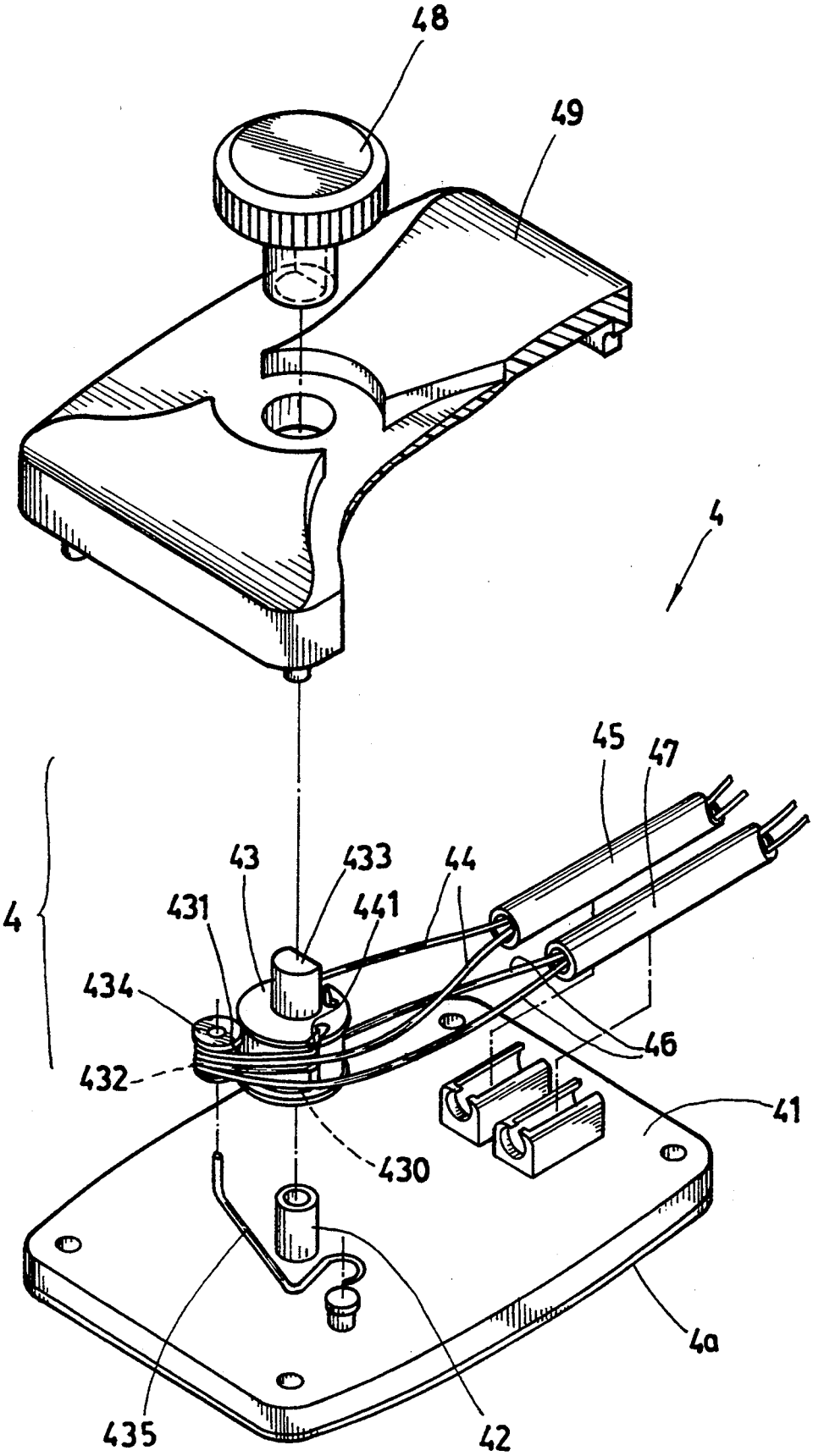
FIG. 4 shows an adjusting means of the present invention.

The adjusting means 4 as shown in FIGS. 4, 5, 1 includes: the driving pulley 43 rotatably mounted on a pivot 42 formed on a housing 41 of the adjusting means 4 having a driving wire end 441 of the wire 44 secured to the driving pulley 43, a knob 48 secured with the driving pulley 43 for rotating the driving pulley 43 for driving the follower pulley 34 of the reflector means 3 for adjusting the deflecting angle of the reflector means 3, and a housing cover 49 shielding the driving pulley 43 in the housing 41 of the adjusting means 4.

The wire 44 jacketed in a sheath 45 is connected between the driving pulley 43 and the follower pulley 34 having a follower wire end portion 442 directed through at least a wire groove 334 recessed in the sleeve member 33 to be secured to the follower pulley 34, with the sleeve member 33 having a clip 333 as shown in FIG. 2, 3 for clamping the sheath 45 of the wire in the clip 333.

The driving pulley 43 includes: a pivot hole 430 formed in a bottom portion of the driving pulley 43 engageable with the pivot 42 on the housing of the adjusting means 4, a first wire groove 431 annularly recessed in an upper periphery of the driving pulley 43 for winding a first wire 44 jacketed in a first sheath 45 and connected to a first reflector means 3, such as adjacent to a left ear, a second wire groove 432 annularly recessed in a lower periphery of the driving pulley 43 for winding a second wire 46 jacketed in a second sheath 47 and connected to a second reflector means 3 such as adjacent to a right ear, whereby upon a rotation of the driving pulley 43 to pull or push both first and second wires 44, 46 to rotate the follower pulley 34, the two reflector members 31, 31 will be rotated about the axis 30 to adjust their deflecting angles for efficiently reflecting the sound waves into the wearer's ears.

The driving pulley 43 has a knob stem 433 protruding upwardly through the housing cover 49 to be connected with the knob 48.

The driving pulley 43 is rotatably engageable with an idler roller 434 rotatably held on a spring stem 435 (FIG. 4) secured on the housing 41 for auxiliarily resiliently tensioning the two wires 44, 46 wound on the driving pulley 43 and the idler roller 34 to efficiently tension the wires 44, 46 for keeping tension in the wires for a sensitive adjusting operation.

The wires 44, 46 are not limited in this invention. Each wire 44 may be a single wire or a wire loop. Each reflector member 31 on each ear may be pulled or pushed by a wire set composed of two wires as shown in the figures, in that one wire is pulled in one direction, while the other wire is pushed in an opposite direction. Even though a flexible rack having teeth formed thereon may be provided in this invention to respectively engage with a driving gear and a follower gear (not shown) for adjusting the biasing angles of each reflector member, thereby substituting the aforementioned driving pulley 43 and the follower pulley 34. The driving pulley 43 may be formed as a driving motor to drive a follower rotor replacing the follower pulley 34.

The present invention may be modified without departing from the spirit and scope of this invention.

The present invention may also serve as a hearing aids for helping a clear listening of a sound from a sound-generating source.

A mirror 4*a* may be adhered on a bottom of the housing 41 of the adjusting means 4 for checking the positioning of the elements of this invention.

I claim:

1. A sound-wave collector comprising:

a headframe secured to a pair of retainer means disposed on two opposite side portions of a wearer's head adjacent to the wearer's two ears; and a pair of reflector means each said reflector means universally pivotally secured to each said retainer means and generally positioned behind each wearer's ear, each said reflector means having a reflecting area extrapolatively diverging outwardly sidewardly from a contour of each wearer's ear to be operatively oriented about each said retainer means for adjusting a deflecting angle of each said reflector means from each said wearer's ear for efficiently reflecting incoming sound waves of multiple frequency ranges into the wearer's ear;

each said reflector means operatively biased for adjusting its reflecting angle by an adjusting means which includes a driving pulley, and a follower pulley operatively driven by said driving pulley for rotating said reflector means for adjusting its deflecting angles through at least a wire;

said headframe 1 including: an overhead bracket having two base members 12 disposed on two opposite end portions of the overhead bracket 11, a fastener belt 13 fastened on a wearer's head H having two ends of the belt 13 respectively secured to the two base members 12, and a pair of head coupling members 16 each said coupling member 16 secured to the base member 12 and pivotally secured to each retainer means 2 adjacent to the wearer's ear E;

said fastener belt 13 having its each end portion secured to a slide member 14 adjustably slidably held on each said base member 12, and each said slide member 14 including a stem 141 protruding outwardly through a slot 121 notched in the base member 12 to be connected with a push button 15 slidably held on an upper surface of the base member 12, and having a lateral extension 142 transversely formed on the slide member to be engageable with a plurality of teeth 122 longitudinally formed on a bottom surface of the base member 12 for a slidable engagement between the slide member 14 and the base member 12 for adjusting the tightness of the belt 13 worn on the wearer's head H by depressing D and moving the push button 15 on the base member 12; and each said retainer means 2 including: a holding plate 21 contacting a side portion of the wearer's head adjacent to the wearer's ear E, a first socket 22 recessed in an upper portion of the holding plate 21 for universally coupling the head coupling member 16 in the first socket 22, a second socket 23 recessed in a rear portion of the holding plate 21 for universally coupling a reflector coupling member 332 of each said reflector means 3, and a locking member 24 for locking the reflector coupling member 332 in the second socket 23 once an orientation of the reflector means 3 on the retainer means 2 is set.

2. A sound-wave collector according to claim 1, wherein said locking member generally formed as a lever has a cam 241 formed on a lower portion of the lever rotatably engageable with a cam socket 242 recessed in one jaw member of the two jaw members 26 bifurcated in a rear portion of the holding plate 21 of the retainer means 2 from a slit 261 communicating with the second socket 23 in the holding plate 21, a tensioning spring 25 having an inner spring end 251 inserted into a spring socket 27 recessed in the holding plate 21 distal from the sam socket 242 and having an outer spring end 252 retaining a pin 240 of the lever of locking member 24 to be normally tensioned for fastening the two jaw members 26 for locking the reflector coupling member 332 in the second socket 23 of the retainer means 2, the locking member 24 being biased outwardly to release the tensioning spring 25 to unlock the reflector coupling means 332 for free adjusting the orientations of the reflector means 3 on the retainer means 2 for efficiently collecting or catching the sound waves of multiple frequency ranges to be reflected into the wearer's ear E.

3. A sound-wave collector according to claim 2, wherein each said reflector means 3 includes: a reflector member 31 generally concave inwardly to form the reflecting area with an arcute shallow recess in a central portion of the reflector member 31 for reflecting sound waves from a sound emitting source into the ear, a shaft 32 formed on a rear portion of the reflector member 31, a sleeve member 33 having a coupling arm member 331 secured with the reflector coupling member 332 universally held in the retainer means 2 rotatably engageable with the shaft 32, and the follower pulley 34 secured with the shaft 32, and also secured with and operatively driven by at least a wire 44 connected to an adjusting means 4, whereby upon an adjusting pulling or pushing of the wire 44 of the adjusting means 4, the follower pulley 34 will be rotated to rotate the shaft 32 and the reflector member 31 about a rotating axis 30 axially defined at a center of the sleeve member 33 to adjust a deflecting angle A of the reflector member 31 for reflecting the incoming soundwaves W into the ear E.

4. A sound-wave collector according to claim 3, wherein said follower pulley 34 includes a central hole 340 formed therethrough to be engageable with a collar 35 having a central collar hole 35 engageable with the shaft 32 of the reflector member 31, the follower pulley 34 having at least a wire groove 341 for fixing a wire end portion of the wire 44 into the wire groove 341 to be driven by the driving pulley 43 of the adjusting means 4 and a projection 342 longitudinally formed in a side wall of the central hole 340 of the follower pulley 34 to be engaged with an outer groove 351 recessed in an outer wall of the collar 35, the collar 35 having an inner projection 352 formed in an inside wall in the collar 35 to be engaged with a shaft groove 321 recessed in the shaft 32, and the shaft 32 having male threads 322 formed on an upper portion of the shaft 32 engageable with female threads formed in a nut 36 for locking the nut 36 on the shaft 32 for limiting the follower pulley 34 on the sleeve member 33.

5. A sound-wave collector according to claim 4, wherein said adjusting means 4 includes: the driving pulley 43 rotatably mounted on a pivot 42 formed on a housing 41 of the adjusting means 4 having a driving wire end 441 of the wire 44 secured to the driving pulley 43, a knob 48 secured with the driving pulley 43 for rotating the driving pulley 43 for driving the follower pulley 34 of the reflector means 3 for adjusting the deflecting angle of the reflector means 3, and a housing cover 49 shielding the driving pulley 43 in the housing 41 of the adjusting means 4.

6. A sound-wave collector according to claim 5, wherein said wire 44 jacketed in a sheath 45 is connected between the driving pulley 43 and the follower pulley 34 having a follower wire end portion 442 directed through at least a wire groove 334 recessed in the sleeve member 33 to be secured to the follower pulley 34, with the sleeve member 33 having a clip 333 for clamping the sheath 45 of the wire in the clip 333.

7. A sound-wave collector according to claim 6, wherein said driving pulley 43 is rotatably engageable with an idler roller 434 rotatably held on a spring stem 435 secured on the housing 41 for winding the two wires 44, 46 on the driving pulley 43 and the idler roller 34 for tensioning the two wires 44, 46 between the two pulleys 43, 34.

8. A sound-wave collector according to claim 5, wherein said driving pulley 43 includes: a pivot hole 430 formed in a bottom portion of the driving pulley 43 engageable with the pivot 42 on the housing of the adjusting means 4, a first wire groove 431 annularly recessed in an upper periphery of the driving pulley 43 for winding a first wire 44 jacketed in a first sheath 45 and connected to a first reflector means 3, adjacent to a left ear, a second wire groove 432 annularly recessed in a lower periphery of the driving pulley 43 for winding a second wire 46 jacketed in a second sheath 47 and connected to a second reflector means 3 adjacent to a right ear, whereby upon a rotation of the driving pulley 43 to pull or push both first and second wires 44, 46 to rotate the follower pulley 34, the two reflector members 31, 31 will be rotated about the axis 30 to adjust their deflecting angles for efficiently reflecting the sound waves into the wearer's ears.

* * * * *